US006116590A

United States Patent [19]

Yokoyama et al.

[11] Patent Number: 6,116,590

[45] Date of Patent: Sep. 12, 2000

[54] PAPER SIZE DISCRIMINATING APPARATUS

[75] Inventors: Koichiro Yokoyama; Kazutoshi Kashiwabara, both of Nagano, Japan

[73] Assignee: Seiko Epson Corporation, Tokyo, Japan

[21] Appl. No.: 09/047,332

[22] Filed: Mar. 25, 1998

[30] Foreign Application Priority Data

Mar. 26, 1997 [JP] Japan ..... 9-091558

[51] Int. Cl.[7] ..... B65H 1/00

[52] U.S. Cl. ..... 271/171

[58] Field of Search ..... 271/145, 205, 271/206, 265.02, 171; 399/389

[56] References Cited

U.S. PATENT DOCUMENTS

| | | | |
|---|---|---|---|
| 5,333,852 | 8/1994 | Milillo et al. . | |
| 5,483,889 | 1/1996 | Hoberock et al. . | |
| 5,743,522 | 4/1998 | Rubscha et al. | 271/265.02 |
| 5,826,156 | 10/1998 | Natsume et al. | 399/389 |
| 5,839,047 | 11/1998 | Hirabayashi et al. | 399/389 |
| 5,890,708 | 4/1999 | Song | 271/10.03 X |
| 5,940,106 | 8/1999 | Walker | 347/104 X |

FOREIGN PATENT DOCUMENTS

| | | |
|---|---|---|
| 0 684 140 A2 | 11/1995 | European Pat. Off. . |
| 0 695 706 A1 | 2/1996 | European Pat. Off. . |

*Primary Examiner*—Christopher P. Ellis
*Assistant Examiner*—Kenneth W. Bower
*Attorney, Agent, or Firm*—Sughrue, Mion, Zinn, Macpeak & Seas, PLLC

[57] ABSTRACT

A paper size discriminator of the size of a stacked printing paper includes a pair of members which are relatively displaced in the direction of the width of the loaded paper. A long detecting plate is attached to one of the members. The detecting plate includes a grove that is progressively stepped in a direction transverse to the width of the paper. A pin sliding in the groove is attached to the other member such that the size of loaded paper is ranked in the direction of the width by detecting the displacement of the pin. The rear end keep plate is displaced corresponding to the length of paper wherein the length of the paper is discriminated by combining output signals from first and second detecting switches.

4 Claims, 6 Drawing Sheets

SW. 3 ON
SW. 3 OFF
e
c'
d
c
b
a
SW. 1 ON
SW. 1 OFF
SW. 2 ON
SW. 2 OFF

PAPER SIZE DISCRIMINATING APPARATUS

BACKGROUND OF THE INVENTION

1. Field of the Invention

This invention relates to a size discriminator of paper as applied to a printer and a copying machine.

2. Description of the Related Art

A recording apparatus is required to suitably print or copy recorded contents according to the size, the type, etc., of printing paper, and to specify the size of stacked printing paper for each purpose.

However, generally, for an instrument used or proposed heretofore for measuring the width or the length of printing paper, the instrument outputs the detected contents in an analog value, and a problem arises where, if there is a slight difference in the cut dimension of the paper, the instrument cannot precisely specify which of the numerous sizes of printing paper is required.

SUMMARY OF THE INVENTION

The object of the present invention is to solve the above problem and provide a new instrument which can precisely discriminate the size of stacked printing paper even if there is a slight difference in the cut dimension.

That is, a paper size discriminator according to the object of the present invention, includes a pair of members relatively displaced in accordance with the width of printing paper, for ranking printing paper in the direction of width by a ranked stepwise groove in the direction of the width of paper provided to one of the pair of members; and position detecting means of each part in the longitudinal direction of paper of the stepwise groove provided to the other member; and a member displaced in the longitudinal direction in accordance with the length of the paper for ranking printing paper in the longitudinal direction by means for detecting displacement and means for discriminating the size of paper based upon data ranked by these members.

A paper size discriminator according to the present invention discriminates the size of stacked printing paper based upon data ranked respectively in the direction of the width and the length of paper as described above.

DETAILED DESCRIPTION OF THE PREFERRED EMBODIMENTS

Figure 1:
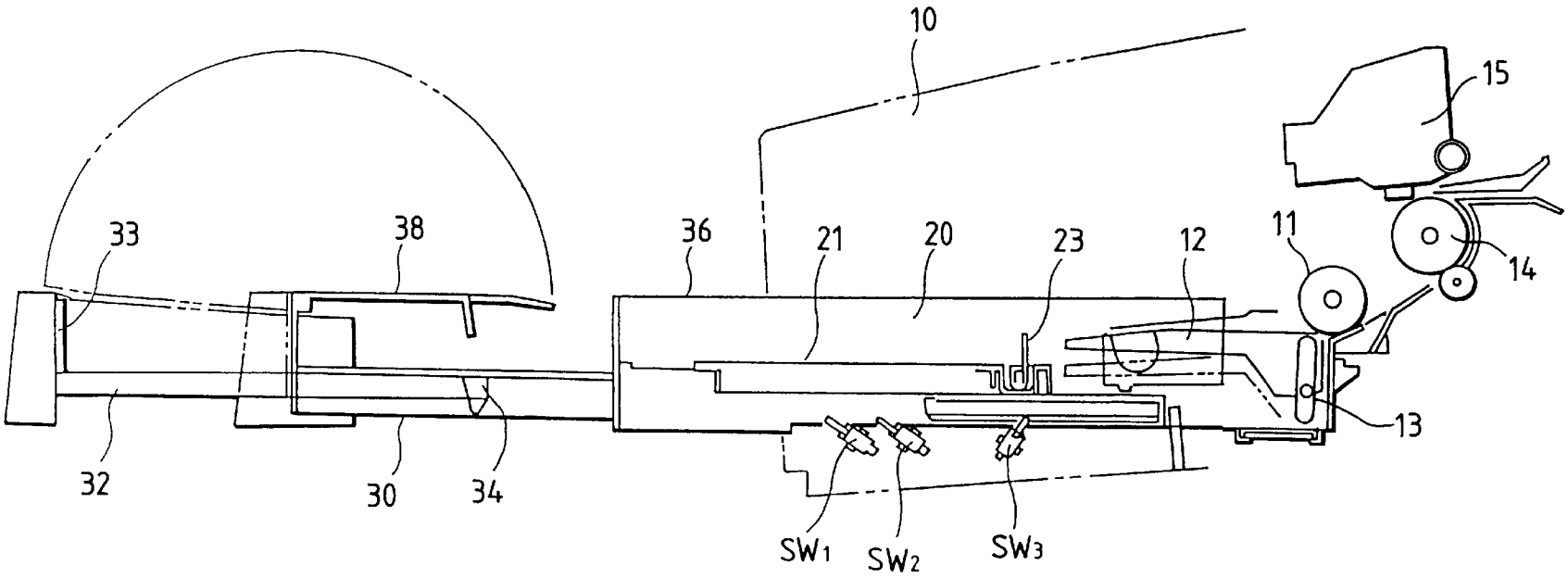
FIG. 1 is a block diagram showing a side view of a paper size discriminator apparatus of one embodiment of the present invention.
Figure 2:
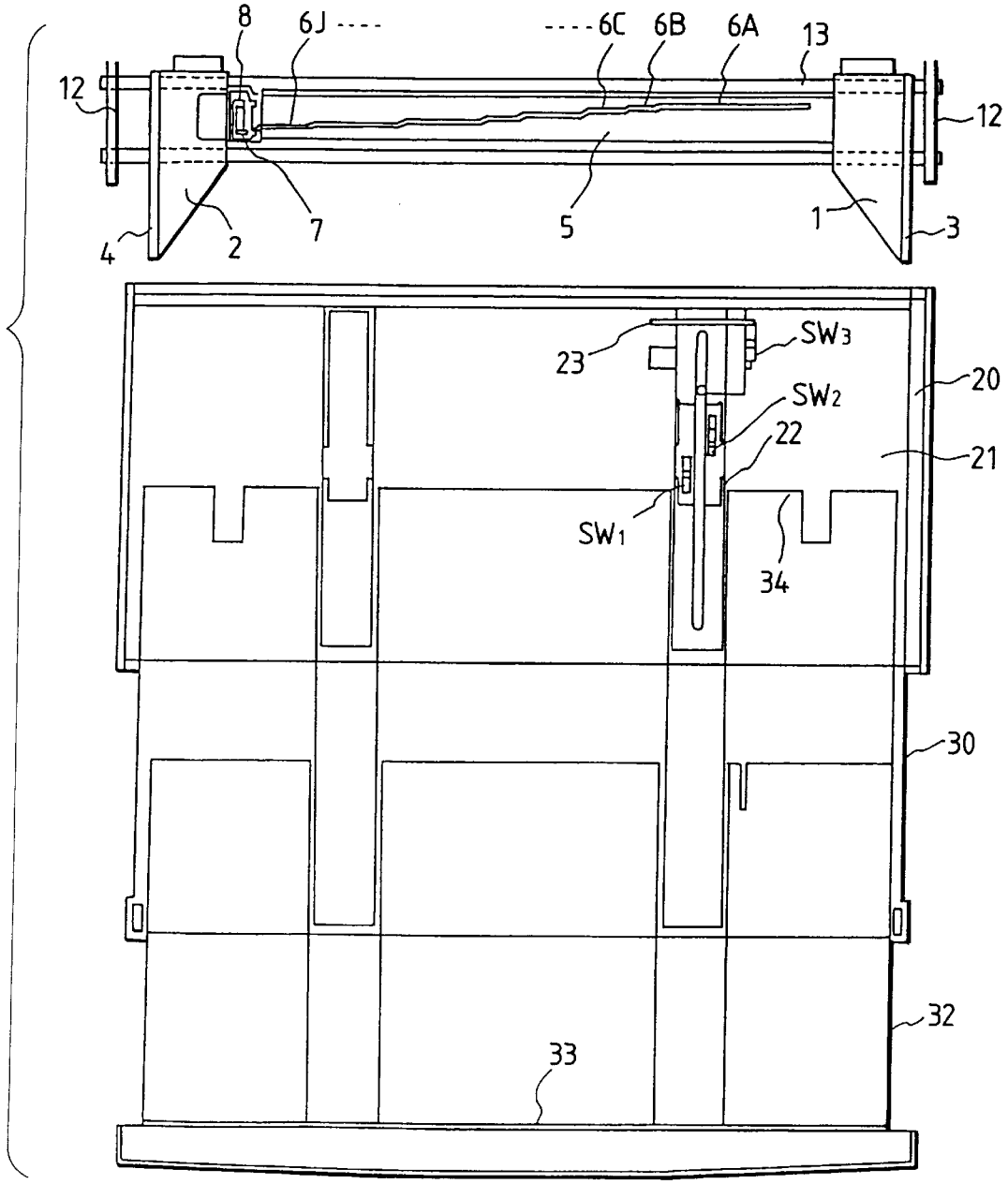
FIG. 2 is a block diagram showing a top view of the above apparatus.

FIGS. 1 and 2 show a paper size discriminator equivalent to a first embodiment of the present invention. A description of the first embodiment follows.

A pair of hoppers shown by reference numbers 1 and 2 in FIG. 2, are operated so that the front end of printing paper loaded onto a cassette 20 is pushed up, and paper at the top is touching a pickup roller 11, with the hoppers 1, 2 being attached to a guide shaft 13 attached to the frame 12 of the body 10 of a printer or a copying machine. The guide shaft 13 can be moved vertically in a state in which the hoppers 1, 2 can be slid and are constituted such that the hoppers 1, 2 are respectively relatively displaced in the direction of the width of the cassette 20 to correspond to the width of the loaded paper.

Figure 3:
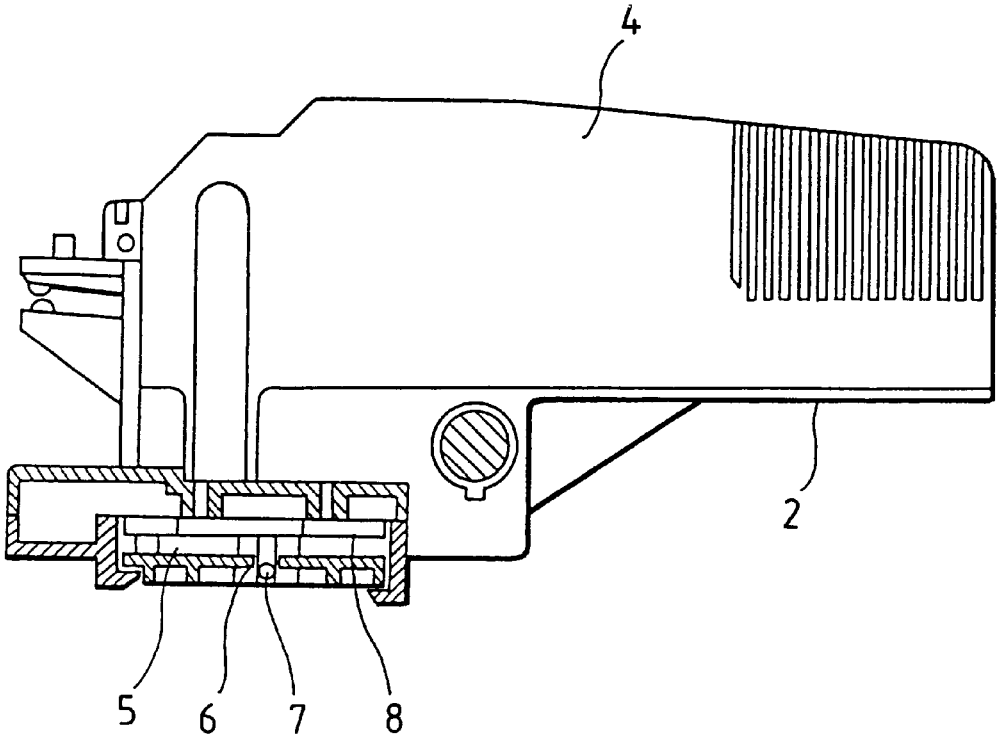
FIG. 3 is a side view showing an edge guide.

Edge guides 3 and 4 for positioning paper in the direction of the width are respectively provided in the shape of a letter L outside these hoppers 1 and 2, and a long detecting plate 5 is integrated with one of these hoppers 1 and 2, the hopper 1 on the right side in FIG. 2 in this embodiment being in the direction of the width. A total of ten ranked grooves 6A, 6B, 6C, . . . , 6J, which are sequentially provided stepwise to the detecting plate 5 in the direction of printing digits for every dimension of each paper size W shown in Table 1. Further, a pin 7 slid in these grooves 6A, 6B, 6C, . . . , 6J is attached to the other hopper 2 in a direction perpendicular to the width of the paper so that the pin 7 can be moved as shown in FIG. 3. The size of loaded paper is ranked in the direction of the width by detecting the displacement of the pin 7 by a potentiometer 8, and is detected digitally.

A reference number 14 denotes a pair of paper feed rollers for feeding paper taken out of the cassette 20 by the pinch roller 11 to a recording head 15.

TABLE 1

| | Interval between right and left edge guides: W (mm) |
|---|---|
| A | $98 \leqq W \leqq 108.6$ and $123.4 \leqq W \leqq 143.3$ |
| B | $161.6 \leqq W \leqq 187.8$ |
| C | $196.6 \leqq W \leqq 232.1$ |
| D | $238.1 \leqq W \leqq 260.6$ |
| E | $276 \leqq W \leqq 283$ |
| F | $293.6 \leqq W \leqq 300.6$ |
| G | $325.4 \leqq W \leqq 332.6$ |
| H | $349.6 \leqq W \leqq 367.6$ |
| I | $411 \leqq W \leqq 423.1$ |
| J | $429.1 \leqq W \leqq 441$ |

In the meantime, a guide groove 22 extended in the longitudinal direction of the paper on the surface 21 on which the paper is loaded, is provided to the body of the cassette 20 and attached with the end which is located close to each hopper 1 and 2. A slider 25 is provided with a rear end keep plate 23 (which can be hoisted), and the slider 25 is attached to the guide groove 22 so that the slider 25 can be slid.

Figure 4A:
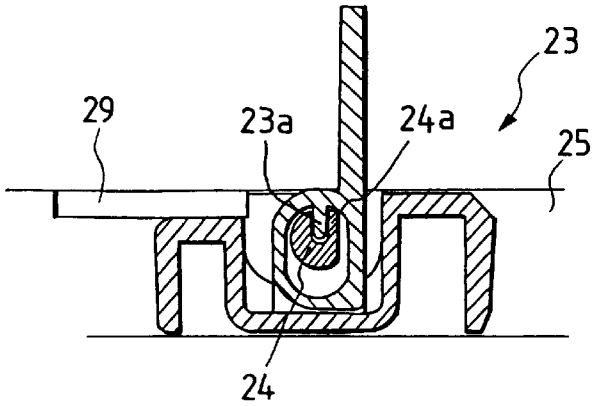
FIGS. 4(*a*) to (*c*) show an operation for hoisting a rear end keep plate used in the above apparatus.
Figure 4B:
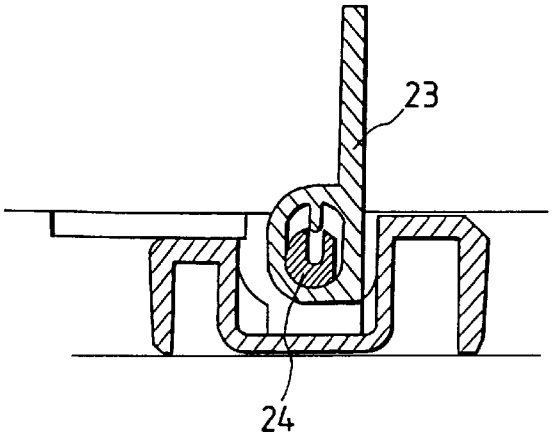
Figure 4C:
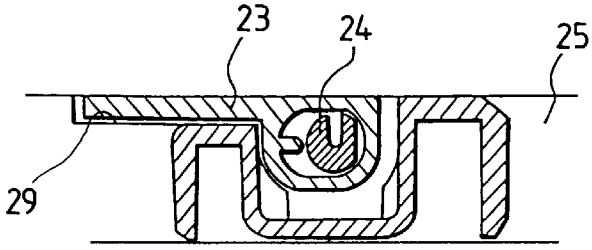
Figure 5A:
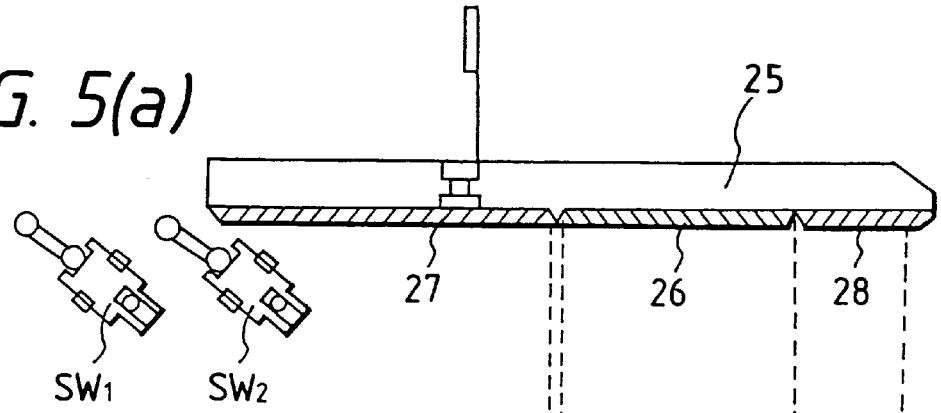
FIGS. 5(*a*) and (*b*) are a side view and a plan view showing a mechanism for ranking the dimension in the longitudinal direction of the printing paper.
Figure 5B:
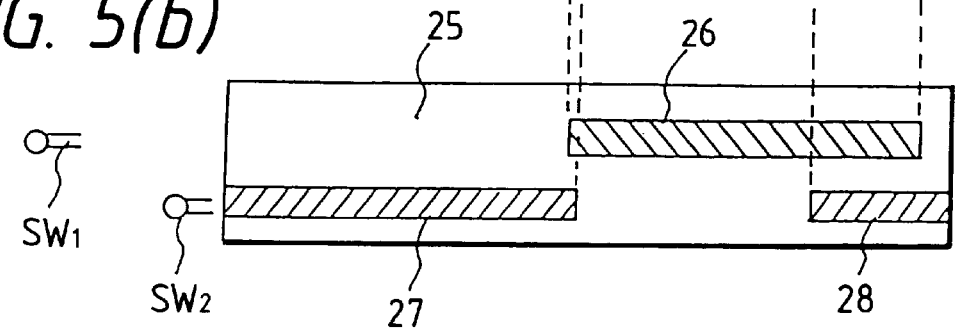

The rear end keep plate 23 is provided to press the rear end of the paper, the length of which is up to 305 mm. The paper is held with the rear end keep plate 23 standing upright by inserting a downward protruded piece 23*a* protruding from the rear end keep plate 23 into an upward inserting groove 24*a* provided to a fixing/turning guide member 24 as shown in FIG. 4, so that longer paper can be folded. The apparatus is constituted so that the rear end keep plate 23 can be housed in a concave portion 29 provided to the slider 25 by pulling out the protruded piece 23*a* and turning the plate 23 along the fixing/turning guide member 24.

First to third detected projections 26, 27, and 28, are formed with them and dislocated in the direction of the width of paper, in parallel, in the longitudinal direction of paper on the lower surface of the slider 25 as shown in FIG.

5, and the projections 26, 27, 28 are constituted so that they can be respectively detected by first and second detecting switches SW1 and SW2 which are provided to the body of the cassette 20.

Figures 6A, 6B, 6C, 6D:
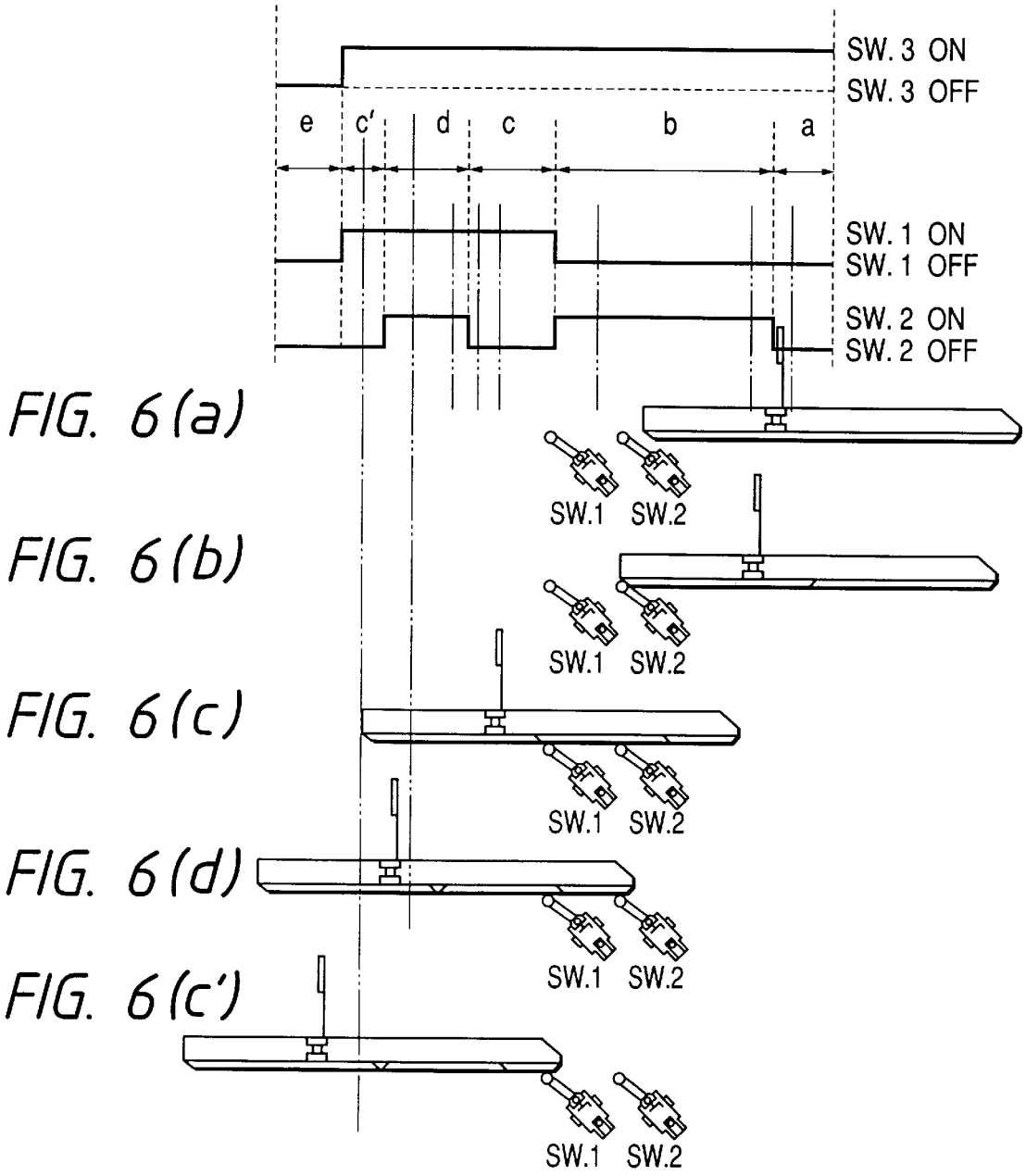
FIG. 6 shows the ranking of the printing paper in the longitudinal direction.

That is, the above detected projections 26, 27, 28 are constituted so that the length of paper can be digitally detected in ranks from an area a to an area e as shown in FIG. 6, by combining output signals from the detecting switches SW1 and SW2 based upon whether the detected projections 26, 27, 28 are detected or not by the two detecting switches SW1 and SW2, by being dislocated both in the direction of the width of paper, and in the longitudinal direction when the slider 25 is moved from the end of the body of the cassette 20 to a position for supporting paper 305 mm long along the guide groove 22. Therefore, the detected projections 26, 27, 28 are constituted so that paper size shown in Table 2, can be detected in ranks by forming the first detected projection 26 from the center in the longitudinal direction on the lower surface of the slider 25 to the vicinity of the end of the body of the cassette 20, forming the second detected projection 27 from the vicinity of the rear end of the body of the cassette 20 to the center, and forming the third detected projection 28 from the center to the vicinity of the end of the body of the cassette 20 in the same line as the second detected projection 27.

TABLE 2

| SW1 | SW2 | SW3 | Paper length rank |
|---|---|---|---|
| 1 | 1 | 0 | a |
| 1 | 0 | 0 | b |
| 0 | 1 | 0 | c |
| 0 | 0 | 0 | d |
| 0 | 1 | 0 | c |
| 1 | 1 | 1 | e |

In the meantime, a paper loading plate 30 which is guided by the guide groove 22 and which is slid in the longitudinal direction, is provided to the rear end of the body of the cassette 20 so that the paper loading plate 30 can be pulled out. Further, a rear end keep auxiliary plate 32 provided with a paper presser foot 33 at the rear end is provided to the paper loading plate 30 in the longitudinal direction so that the rear end keep auxiliary plate 32 can be slid. A detecting part 34 is protruded toward the lower end of the rear end keep auxiliary plate 32 and is housed in an area in which a third detecting switch SW3 is provided to the body of the cassette 20. The read end keep auxiliary plate 32 and the paper loading plate 30 are housed in the body of the cassette 20. By touching the paper presser foot 33 to the rear end face of the body of the cassette 20, a longitudinal dimension of paper 305 mm long or longer, can be ranked by combining output signals from the third detecting switch SW3 and the above first and second detecting switches SW1 and SW2.

A guide plate 36 for manually inserted paper is provided with the upper surface of the cassette 20. Reference number 38 denotes an extension plate which is provided at the rear end so that the extension plate 38 can be opened or closed.

In the embodiment constituted as described above, paper in a relatively small size is loaded on the body of the cassette 20 with the rear end keep plate 23 stood upright. Further, when one or both of the right and left hoppers 1 and 2 is/are moved, the width of the paper is positioned by the edge guides 3 and 4, and the rear end of the paper is positioned by the rear end keep plate 23.

The right and left hoppers 1 and 2 are relatively displaced by the above operation so that they correspond to the width of the paper. The quantity of the displacement is detected by the potentiometer 8 as the displacement in the direction of the length of paper by the pin 7 which is slid in the grooves 6A, 6B, 6C, . . . , 6J, and respectively provided to the detecting plate 5 and ranked in any order of A to J. The quantity of the displacement of the rear end keep plate 23—displaced so that the rear end keep plate 23 corresponds to the length of paper—is similarly ranked in any of a to e by combining output signals from the first and second detecting switches SW1 and SW2 for detecting each detected projection 26, 27, and 28, on the lower surface of the slider 25.

If the length of paper exceeds 305 mm, the rear end keep auxiliary plate 32 is pulled out at the rear of the body of the cassette 20, and the rear end of the loaded paper is pressed after the rear end keep plate 23 is pulled up, fitting between the inserting groove 24*a* and the protruded piece 23*a*. The protruded piece 23*a* is released and the rear end keep plate 23 is pushed down. Thereby, the longitudinal dimension of paper is ranked as 'e' by combining output signals from the first to third detecting switches SW1, SW2 and SW3.

The paper size is discriminated as shown in Table 3, in the case of domestic paper, and as shown in Table 4, in the case of paper produced abroad, based upon the data in each rank of the width and the length of paper ranked as described above and input to the body of the printer or copying machine after the above data is checked with data written in a memory.

TABLE 3

| Paper width | Paper length a | Paper length b | Paper length c | Paper length d | Paper length e |
|---|---|---|---|---|---|
| A | A6 | | C1 | | |
| B | | | B5 | | |
| C | | | A4 | Letter | Legal |
| D | | B5 (L) | | | B4 |
| E | | Letter (L) | | | |
| F | | A4 (L) | | | A3 |
| G | | | | | A3+ |
| H | | Legal (L) | B4 (L) | | B3 |
| I | | | A3 (L) | | A2 |

TABLE 4

| Paper width | Paper length a | Paper length b | Paper length c | Paper length d | Paper length e |
|---|---|---|---|---|---|
| A | | Statement | C | | |
| B | | A5 | B5 | Executive | |
| C | Statement (L) | | A4 | Letter | Legal |
| D | | B5 (L) | | | B4 |
| E | | Letter (L) | | | Ledger |
| F | | A4 (L) | | | A3 |
| G | | | | | A3+ |
| H | | Legal (L) | BE (L) | | B3 |
| I | | | A3 (L) | | A2 |
| J | | | | | USC |

The present invention is described above using an example in which paper is fed with the center as a reference point. However, in case paper is fed with one side as a reference point, as in a printer, the width of paper may be ranked by fixing one of the hoppers 1 and 2 and moving the other hopper, using the one hopper as a reference.

In an apparatus in which a platen gap is adjusted according to the thickness of used paper, such as in a printer, the size in a thick paper mode of domestic paper, and paper produced abroad, can be discriminated as shown in Tables 5 and 6, based upon data in the adjustment, and each data ranked in the directions of the width and the length of paper.

TABLE 5

| Paper width | Paper length a |
|---|---|
| A | Postal card |
| B | |
| C | Double postal card |

TABLE 6

| Paper width | Paper length a | Paper length b | Paper Length c |
|---|---|---|---|
| A | A6 Index | Index card 5*8" | |
| B | | | |
| C | Envelope DL | Envelope C5 | Index card 8*10" |
| D | Envelope #10 | | |

As described above, according to the present invention, as the size of printing paper is discriminated based upon data obtained from a member displaced corresponding to the dimension in the direction of the width of the printing paper for ranking the printing paper in the direction of the width based upon the position in the longitudinal direction of the printing paper of a stepwise groove ranked in the direction of the width of the printing paper provided to one of a pair of member; and a member displaced corresponding to the dimension in the longitudinal direction of the printing paper for ranking the printing paper in the longitudinal direction; the printing paper being ranked in the direction of the width and the longitudinal direction, the printing paper of various sizes used for a printer or a copying machine is precisely discriminated based upon the ranked data and the contents to be recorded according to the size of the printing paper.

It is contemplated that numerous modifications may be made to the apparatus of the present invention without departing from the spirit and scope of the invention as defined in the following claims.

What is claimed is:

1. A paper size discriminating apparatus for determining a size of paper loaded in an image recording apparatus, comprising:

a pair of members relatively displaced in a direction of a width of said paper, the relative displacement corresponding to said width of said paper, wherein a first of said pair of members has a groove including a plurality of stepped portions progressively increasing in dimension in the direction transverse to the relative displacement, detecting means provided to a second of said pair of members for detecting a position at each of said stepped portions of said groove;

a member which is displaced in the longitudinal direction in accordance with a dimension in the longitudinal direction of said paper corresponding to a length of said loaded paper;

displacing means for detecting displacement of said member in said longitudinal direction of said paper and determining a size of said paper in said longitudinal direction; and discriminating means for discriminating a size of said paper based upon data provided by said pair of members and said displacing means.

2. The paper size discriminating apparatus according to claim 1, wherein said pair of members determine a position in the direction of the width and the longitudinal direction of said paper by using said discriminating means.

3. The paper size discriminating apparatus according to claim 1, wherein said member which displaces said paper in the longitudinal direction includes a member provided with two detected projections dislocated in the longitudinal direction of said paper so that said two detected projections are detected by two detecting means arranged with said two detected projections and dislocated on a fixing member in the direction of the width of said paper.

4. The paper size discriminating apparatus according to claim 1, wherein a platen gap is adjusted according to data of a thickness of paper used, and said thickness data, except data from said pair of members, is used as means for discriminating the size of said paper.

* * * * *